US011046405B1

(12) United States Patent
Groeschel et al.

(10) Patent No.: US 11,046,405 B1
(45) Date of Patent: Jun. 29, 2021

(54) RIGGING HOSE HOUSING WITH WATER DRAIN

(71) Applicant: Brunswick Corporation, Mettawa, IL (US)

(72) Inventors: John A. Groeschel, Theresa, WI (US); Donald D. Swiertz, West Bend, WI (US)

(73) Assignee: Brunswick Corporation, Mettawa, IL (US)

( * ) Notice: Subject to any disclaimer, the term of this patent is extended or adjusted under 35 U.S.C. 154(b) by 82 days.

(21) Appl. No.: 16/723,465

(22) Filed: Dec. 20, 2019

(51) Int. Cl.
*B63H 9/04* (2020.01)
*B63B 43/16* (2006.01)
*B63H 9/10* (2006.01)

(52) U.S. Cl.
CPC ..... *B63H 9/10* (2013.01); *B63B 43/16* (2013.01)

(58) Field of Classification Search
CPC .. B63H 20/00; B63H 20/02; B63H 2020/025; B63H 20/04; B63H 20/32; B63H 9/10; B63B 19/00; B63B 19/08; B63B 17/00; B63B 2770/00; B63B 2735/00; B63B 2710/00; B63B 2704/00; B63B 2221/00; B63B 2231/00; B63B 69/00
USPC ..... 114/111, 173, 174, 196, 197, 198, 182, 114/227, 228, 343, 355, 364, 382; 440/111, 112, 113
See application file for complete search history.

(56) References Cited

U.S. PATENT DOCUMENTS

| | | | | |
|---|---|---|---|---|
| 4,693,690 | A | 9/1987 | Henderson | |
| 4,969,847 | A | 11/1990 | Curtis et al. | |
| 5,637,021 | A | 6/1997 | Watanabe | |
| 6,257,940 | B1 | 7/2001 | Dunham et al. | |
| 6,364,724 | B1 | 4/2002 | Nozawa et al. | |
| 7,104,856 | B1 * | 9/2006 | Krupp | B63H 20/32 440/76 |
| 7,704,109 | B2 * | 4/2010 | Arai | B63H 20/32 440/76 |
| 8,834,216 | B1 | 9/2014 | Calamia et al. | |
| 8,858,280 | B1 | 10/2014 | Wiegele et al. | |
| 10,017,136 | B1 | 7/2018 | Waisanen et al. | |
| 10,046,842 | B2 | 8/2018 | Mizutani | |
| 10,202,180 | B1 | 2/2019 | Amerling et al. | |
| 10,286,989 | B1 | 5/2019 | Amerling et al. | |

FOREIGN PATENT DOCUMENTS

| | | |
|---|---|---|
| EP | 1316499 | 5/2008 |
| JP | H11245891 | 9/1999 |

* cited by examiner

*Primary Examiner* — Daniel V Venne
(74) *Attorney, Agent, or Firm* — Andrus Intellectual Property Law, LLP

(57) ABSTRACT

A rigging hose housing is provided to couple a rigging hose to a marine vessel. The rigging hose housing includes a radial mounting plate; an outer cylindrical wall extending perpendicularly from the radial mounting plate a first height above a bottom surface of the radial mounting plate; an inner cylindrical wall extending perpendicularly from the radial mounting plate a second height above the bottom surface of the radial mounting plate; and a gutter formed between the inner cylindrical wall and the outer cylindrical wall. The gutter terminates in a drain hole formed in the outer cylindrical wall. The drain hole is configured to permit the expulsion of fluid collected in the gutter from the rigging hose housing.

20 Claims, 5 Drawing Sheets

RIGGING HOSE HOUSING WITH WATER DRAIN

FIELD

The present disclosure relates to marine vessels and watercraft, and more particularly, pertains to rigging systems for coupling outboard motors to a marine vessel.

BACKGROUND

U.S. Pat. No. 4,969,847 discloses a strain relief assembly for an outboard motor for relieving strain on wires, cables, lines or the like that extend between the boat and the cowl assembly, which encloses the power head of the outboard motor. The strain relief assembly is preferably disposed within an opening formed in one of the cowl sections, and comprises a two-piece member. The two-piece member includes a series of indentations which cooperate to clamp the wires, cables, lines or the like therebetween when screwed together. With the strain relief assembly fixed to the wall of the cowl section forming the opening, this acts to maintain the wires, cables or lines in position relative to the cowl section for relieving strain thereon during movement of the outboard motor. A fuel line strain relief assembly is also provided, comprising a stem fixed to the two-piece member. An external fuel line supplies fuel to the stem, which is communicated therethrough to an internal fuel line extending between the stem and the power head.

U.S. Pat. No. 10,017,136 discloses an outboard motor that can be coupled to a transom of a marine vessel via the described rigging system. The rigging system includes a plurality of engine-sourced lines extending from an engine of the outboard motor, through an aperture in the motor housing, and to the marine vessel. A protective tube surrounds the plurality of engine-sourced lines and has a first end coupled to the motor housing and a second end coupled to the marine vessel. A rigging center is located aboard the marine vessel and holds distal ends of each of the engine-sourced lines. A plurality of connectors is provided on the distal ends of the engine-sourced lines. At the rigging center, each engine-sourced line is configured to be coupled, via a respective connector, to a corresponding vessel-sourced line. The vessel-sourced lines are in turn connected to respective engine-related devices aboard the marine vessel.

U.S. Pat. No. 10,046,842 discloses an outboard motor mounting structure that mounts an outboard motor body on a hull and includes a mounting bracket fixed to the hull, a swivel bracket joined to the mounting bracket to be tiltable around a tilt axis and that supports the outboard motor body, a flexible connector, and a first connector support that supports the flexible connector at a support position in a region adjacent to the mounting bracket. The relative position of the support position with respect to the mounting bracket does not change depending on a tilt angle of the outboard motor body. The flexible connector includes at least one of a wire, an operating cable, and a pipe that connects equipment on the hull and equipment provided in the outboard motor body. The adjacent region is a region defined between an upper surface of the hull and the engine cover and between a lowest point of the engine cover and the tilt axis in a state that the outboard motor body is tilted up at a maximum tilt angle.

Japanese Patent No. 11,245,891 discloses an outboard motor that includes an upper cowling and a lower cowling which cover an engine, a through hole passing through the lower cowling, a plurality of linear members, such as cables, wires, and hoses, placed in the through hole and brought out forward from within the lower cowling, and a rigging tube having the linear members inserted therein and having a spiral rib formed on the outer surface thereof. A rigging tube mounting hole part having a spiral groove formed on the inner surface thereof is formed in the through hole, and the rigging tube is fitted into the rigging tube mounting hole part and extended forward from the lower cowling. Also, the rib on the rigging tube is engaged in the groove of the rigging tube mounting hole part.

Each of the above patents is hereby incorporated herein by reference in its entirety.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

According to one example of the present disclosure, a rigging hose housing is provided to couple a rigging hose to a marine vessel. The rigging hose housing includes a radial mounting plate; an outer cylindrical wall extending perpendicularly from the radial mounting plate a first height above a bottom surface of the radial mounting plate; an inner cylindrical wall extending perpendicularly from the radial mounting plate a second height above the bottom surface of the radial mounting plate; and a gutter formed between the inner cylindrical wall and the outer cylindrical wall. The gutter terminates in a drain hole formed in the outer cylindrical wall. The drain hole is configured to permit the expulsion of fluid collected in the gutter from the rigging hose housing.

According to another example of the present disclosure, a rigging hose assembly for a marine vessel is provided. The rigging hose assembly includes a structural component of the marine vessel, and a rigging hose configured to encapsulate at least one of a hose, wire, or cable extending between an outboard motor and the marine vessel. The rigging hose includes multiple external threads. The rigging hose assembly further includes a rigging hose housing mounted to the structural component and threadably coupled to the external threads of the rigging hose. The rigging hose housing includes a radial mounting plate, an outer cylindrical wall extending perpendicularly from the radial mounting plate, an inner cylindrical wall extending perpendicularly from the radial mounting plate, and a gutter formed between the inner cylindrical wall and the outer cylindrical wall. The gutter terminates in a drain hole formed in the outer cylindrical wall. The drain hole is configured to permit the expulsion of fluid collected in the gutter from the rigging hose housing.

According to yet another example of the present disclosure, a rigging hose assembly for a marine vessel is provided. The rigging hose assembly includes a rigging hose configured to encapsulate at least one of a hose, wire, or cable extending between an outboard motor and the marine vessel. The rigging hose includes multiple external threads. The rigging hose assembly further includes a rigging hose housing mounted to the marine vessel and threadably coupled to the external threads of the rigging hose. The rigging hose housing includes a radial mounting plate, an outer cylindrical wall extending perpendicularly from the radial mounting plate, an inner cylindrical wall extending perpendicularly from the radial mounting plate, and a gutter formed between the inner cylindrical wall and the outer cylindrical wall. The gutter terminates in a drain hole formed in the outer cylindrical wall. The rigging hose housing is oriented relative to the marine vessel to aid an expulsion of fluid collected in the gutter through the drain hole.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clearness and understanding. No unnecessary limitations are to be inferred therefrom beyond the requirement of the prior art because such terms are used for descriptive purposes only and are intended to be broadly construed.

Figure 1B:
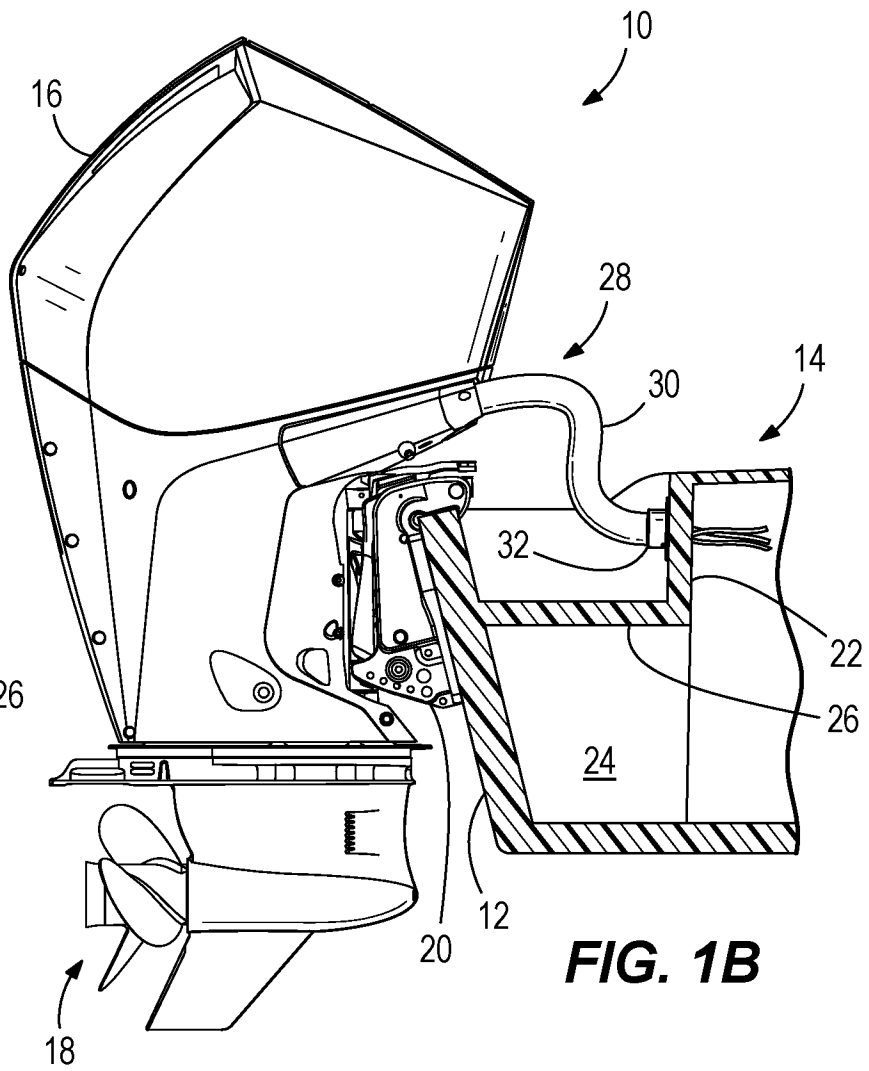
FIG. 1B is a sectional view of an outboard motor for a marine vessel with a rigging hose housing mounted in a vertical orientation in accordance with the present disclosure.
Figure 1A:
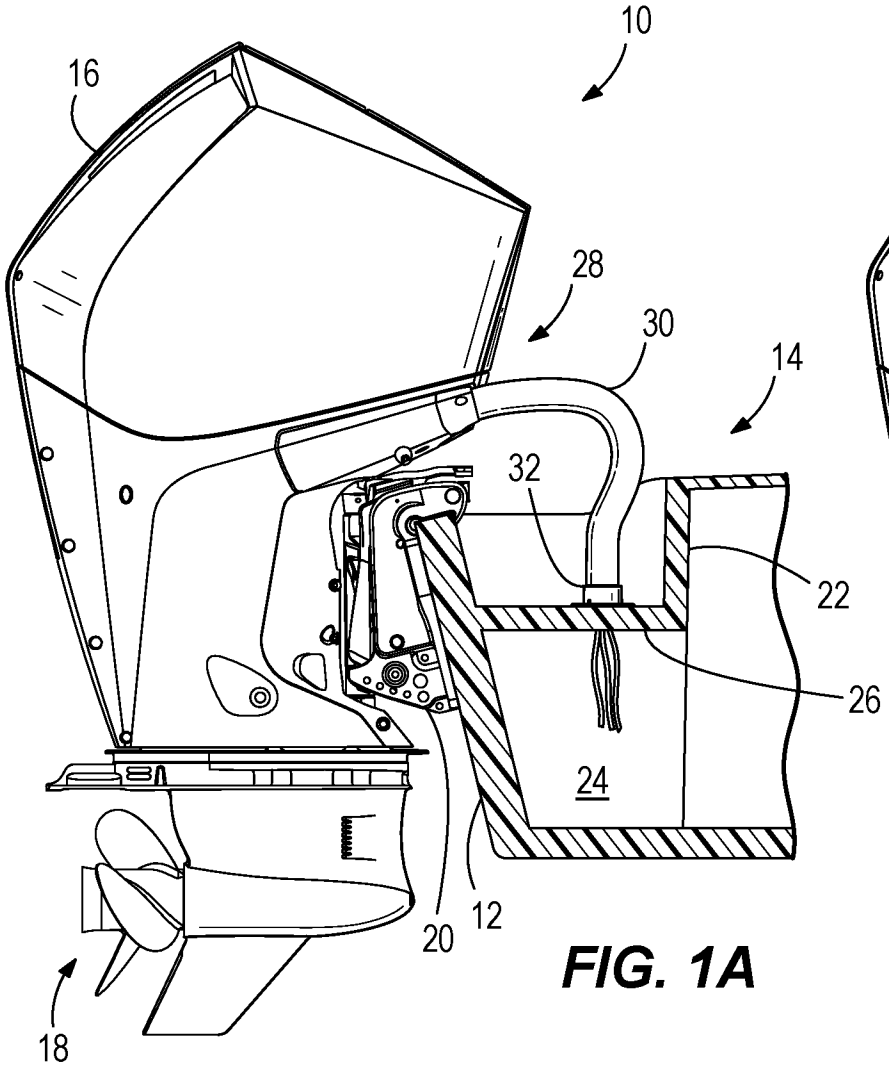
FIG. 1A is a sectional view of an outboard motor for a marine vessel with a rigging hose housing mounted in a horizontal orientation in accordance with the present disclosure.

FIGS. 1A and 1B illustrate an outboard motor 10 for coupling to a transom 12 of a marine vessel 14. The outboard motor 10 includes an engine located within an engine housing or cowl 16. The engine is coupled in a torque-transmitting relationship with a propulsor 18. The propulsor 18, although shown herein as a single propeller, could be any type of propulsor such as a dual counter-rotating propeller, a jet drive, or an impeller, and is not limiting on the scope of the present disclosure. Similarly, the engine within the cowl 16 could be any type of engine, and specifics of the engine are not limiting on the scope of the present disclosure.

The outboard motor 10 is coupled to the transom 12 of the marine vessel 14 by way of a transom bracket 20. Using actuators provided on the transom 12 or on the transom bracket 20, the outboard motor 10 can be steered, tilted, trimmed, and moved in various ways in order to provide different directions of propulsive force to propel the marine vessel 14 in different directions. Commands to move the outboard motor 10 in such a manner can be provided by various outboard motor-related and/or engine-related devices aboard the marine vessel 14.

The marine vessel 14 further includes a false transom 22 provided just fore of the true transom 12. A compartment 24 is formed below an upper wall 26 extending between transom 12 and false transom 22. In an exemplary implementation, compartment 24 may be used for storage of a battery, as well as one or more fuel tanks.

Typically, various hoses, wires, cables, or the like extend between the outboard motor 10 and the marine vessel 14. For example, the electrical system for an internal combustion engine-driven outboard motor includes a wide variety of diverse electrical control components. A rigging hose assembly 28 may extend between the powerhead and a steering remote control that is mounted at the helm (not shown) of the marine vessel 14. The rigging assembly 28 may contain electrical lines that relay digital throttle and shift commands (or push-pull cables that relay manual throttle and shift commands) between the helm and the powerhead as well. Electrical lines relaying other types of control signals may also be present.

Many of the electrical control components are subject to high corrosion and/or their performance is adversely affected if they get wet. Although the engine housing or cowl 16 provides some protection from environmental damage, most engine-mounted electrical components are still subject to corrosive attack as well as the possibility of becoming damp or wet. Therefore, rigging hose assembly 28 is shown to include a rigging hose 30 that encapsulates the various hoses, wires, and cables running between the outboard motor 10 and the marine vessel 14. A first end of the rigging hose 30 is shown to be coupled to the cowl 16 of the outboard motor 10, and a second end of the rigging hose 30 is shown to be coupled to a rigging hose housing 32.

As depicted in FIGS. 1A and 1B, the rigging hose housing 32 can be mounted to the marine vessel 14 in multiple orientations based on the design or type of the marine vessel 14. FIG. 1A depicts the rigging hose housing 32 mounted to the horizontally-oriented upper wall 26 located between the transom 12 and the false transom 22. FIG. 1B depicts the rigging hose housing 32 mounted to the vertically-oriented false transom.

Figure 2:
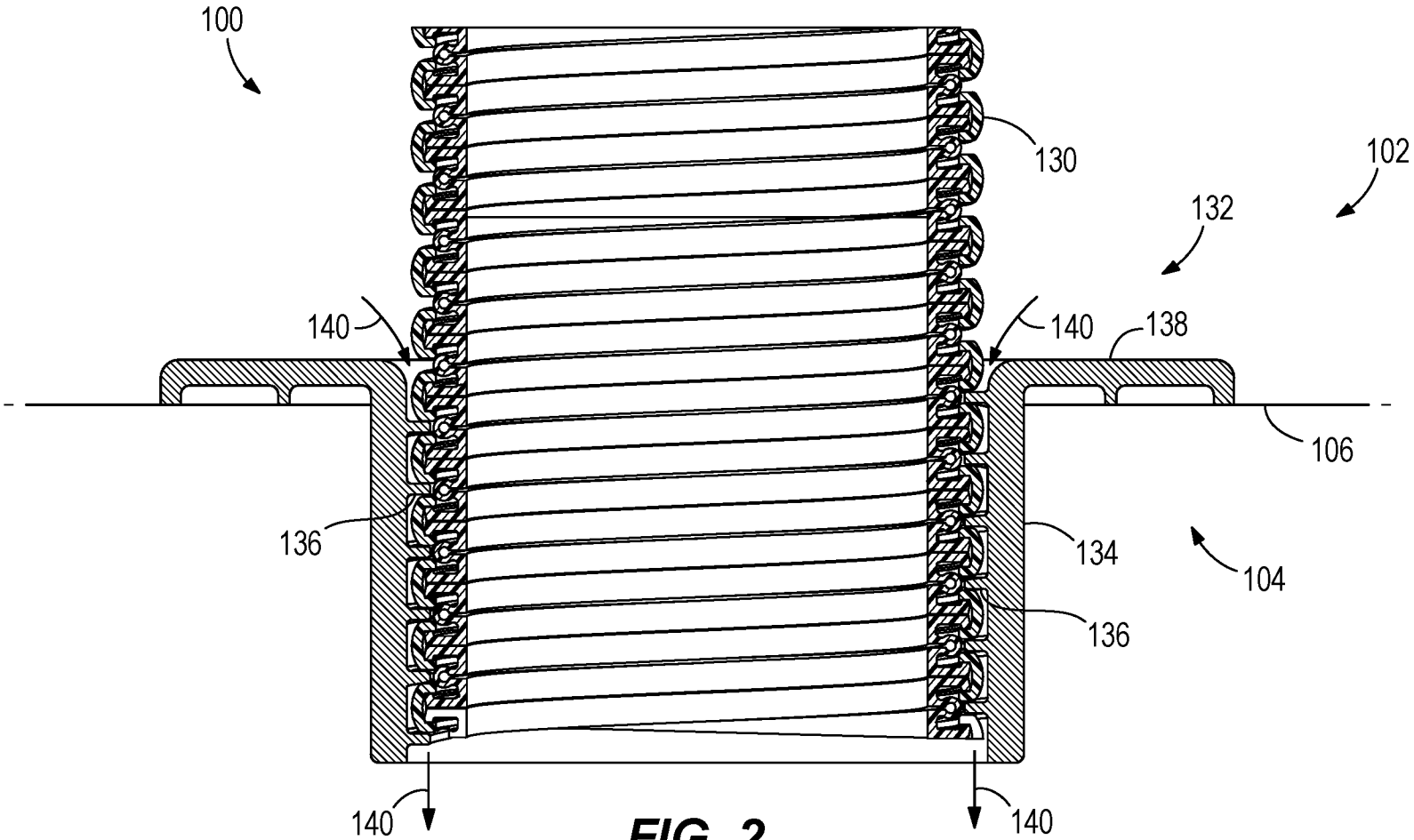
FIG. 2 PRIOR ART
FIG. 2 is a sectional view of a prior art rigging hose housing.

Referring now to FIG. 2, a sectional view of an existing rigging hose assembly 100 is shown. The rigging hose assembly 100 includes a rigging hose 130 coupled to a rigging hose housing 132. The rigging hose housing 132 includes a central cylindrical wall 134 and a radial mounting plate 138. The central cylindrical wall 134 includes multiple internal threads 136 that threadably couple to a helical outer surface of the rigging hose 130.

The radial mounting plate 138 is shown to be mounted to wall 106 on the exterior 102 of the vessel 14, while the central cylindrical wall 134 extends into the interior 104 of the vessel 14. The features and mounting location of the existing rigging hose housing 130 leave the marine vessel susceptible to significant water intrusion. Specifically, a water intrusion path 140 is formed by the coupling of the rigging hose 130 to the rigging hose housing 132. As shown, path 140 begins at the intersection of the radial mounting plate 138 and the central cylindrical wall 134. From there, the water is directed to travel down the rigging hose 130, following the helical outer surface. Upon reaching a terminating end of the rigging hose 130 within the vessel interior 104, the rigging hose housing 132 provides no impediment to the water simply falling down or otherwise entering the bilge area of the marine vessel along path 140.

Figure 3:
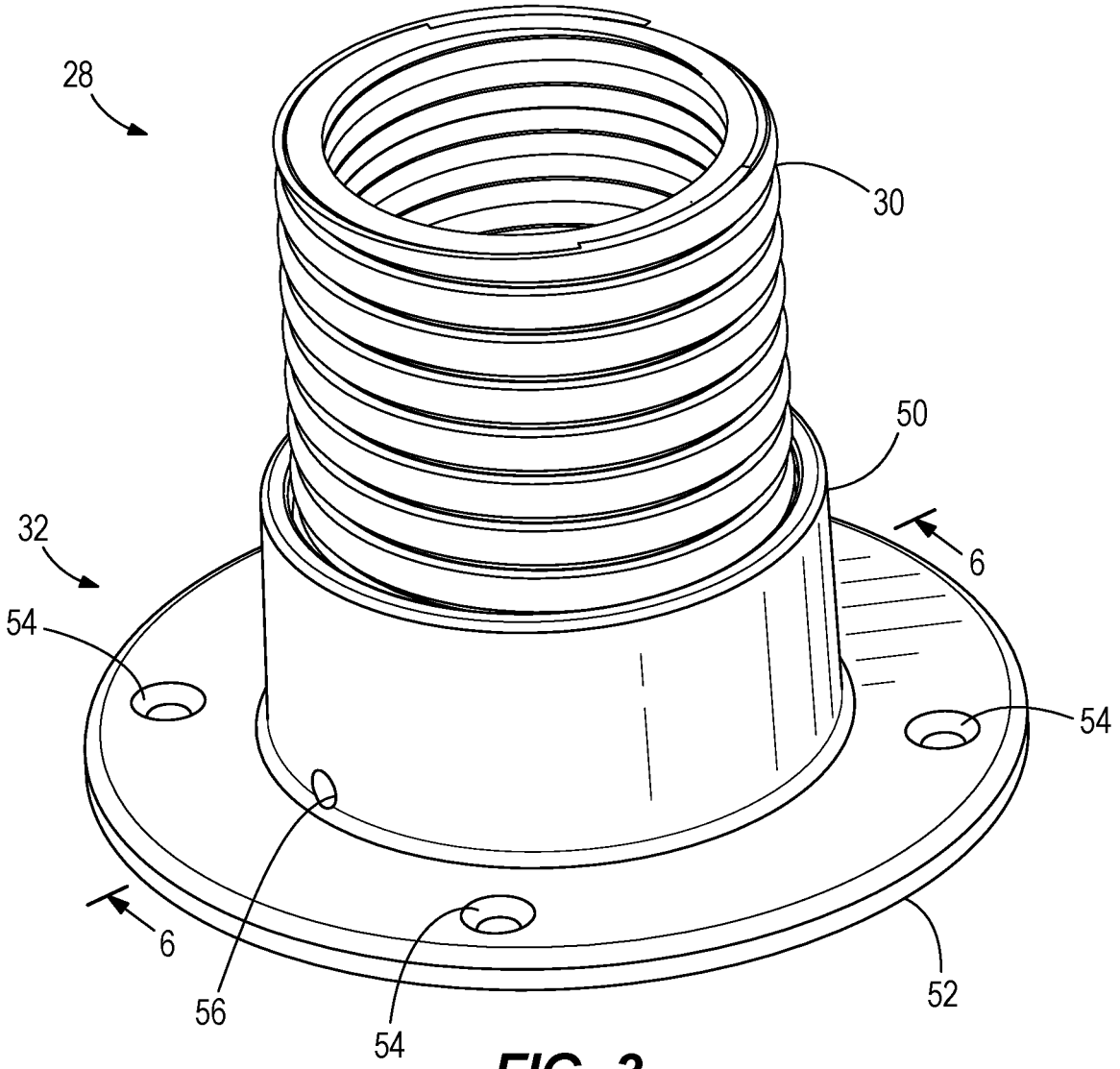
FIG. 3 is a perspective view of the rigging hose and rigging hose housing of FIGS. 1A and 1B.
Figure 4:
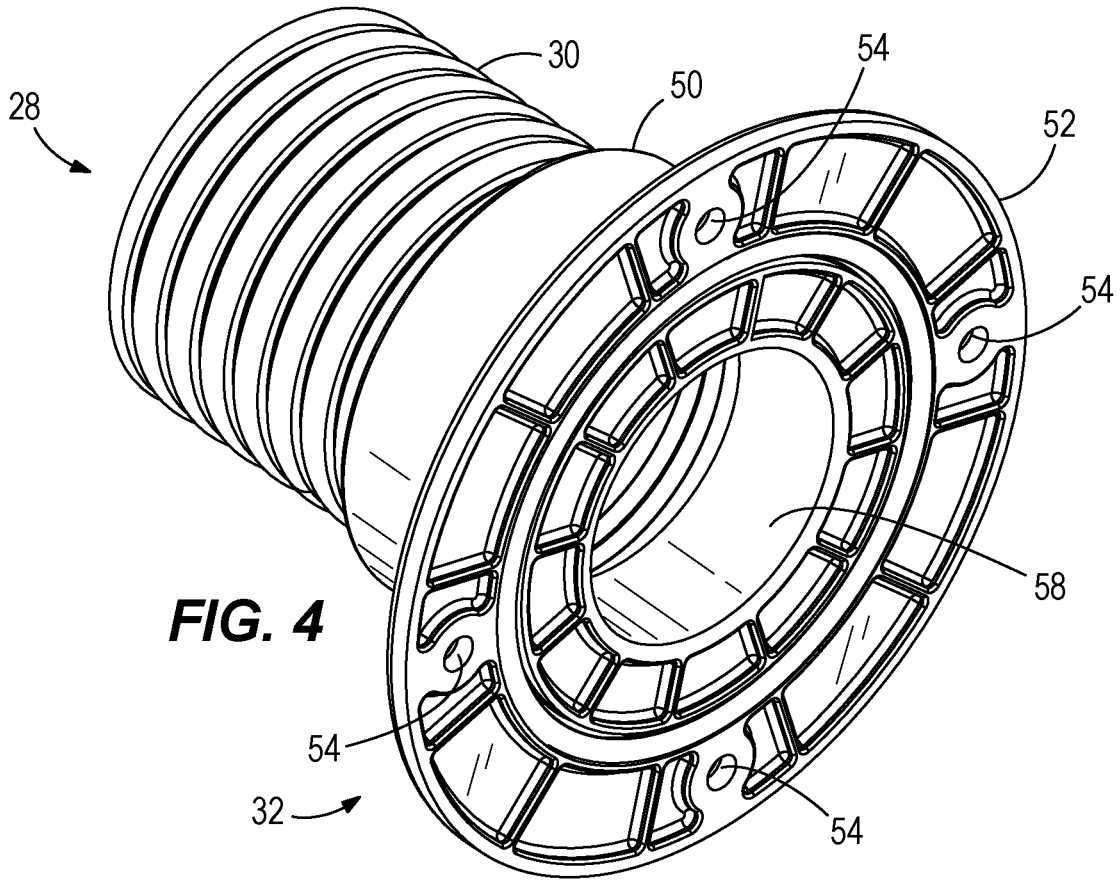
FIG. 4 is a perspective view of the rigging hose and rigging hose housing of FIGS. 1A and 1B.
Figure 5:
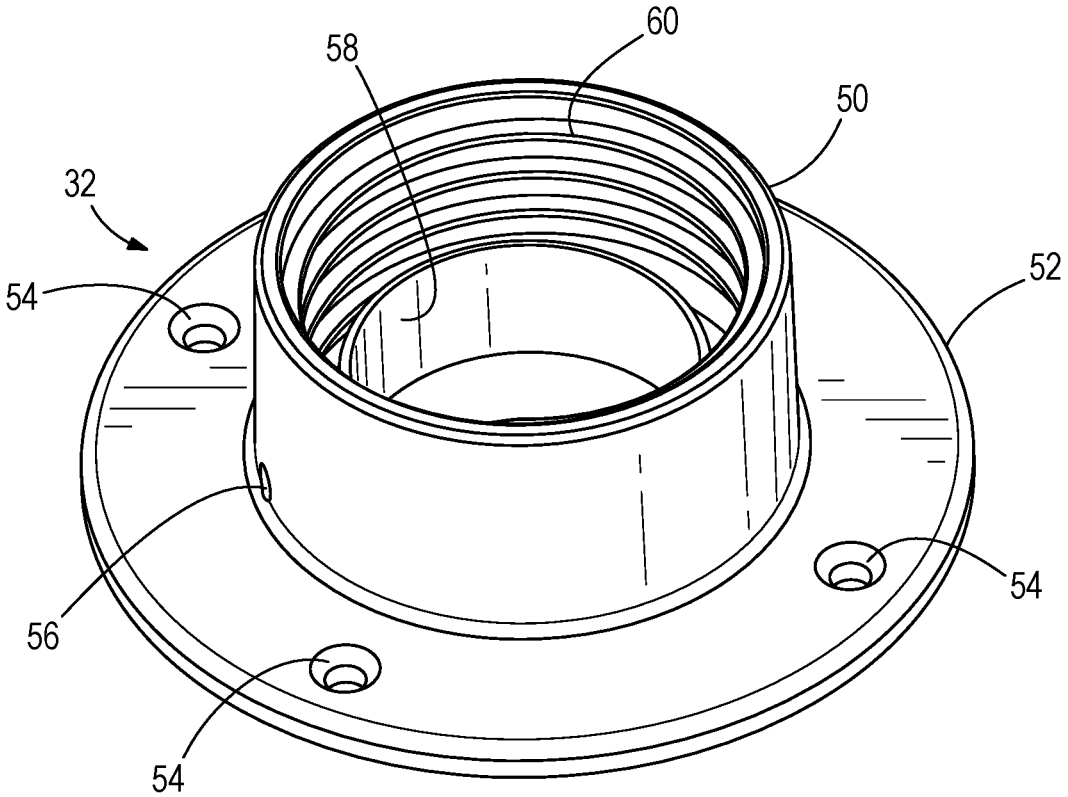
FIG. 5 is a perspective view of the rigging hose housing of FIGS. 1A and 1B.

Turning now to FIGS. 3-5, several views of an improved rigging hose housing 32 according to the present disclosure are depicted. Specifically, FIGS. 3 and 4 depict perspective views of a rigging hose assembly 28 including a rigging hose 30 coupled to the rigging hose housing 32. FIG. 5 depicts a perspective view of the rigging hose housing 32 in isolation.

The rigging hose housing 32 is shown to include an outer cylindrical wall 50 and a radial mounting plate 52. In some implementations, as specifically depicted in FIG. 4, the radial mounting plate 52 includes multiple recesses that extend through a portion of the plate 52. The recesses may decrease the amount of material required to fabricate the rigging hose housing 32, and may decrease the risk of creating cosmetic sink marks on the marine vessel 14 when the rigging hose housing 32 is coupled to the marine vessel 14. Referring specifically to FIG. 5, the rigging hose housing 32 is further shown to include an inner cylindrical wall 58 nested inside the outer cylindrical wall 50, and multiple threads 60 formed on the interior of the outer cylindrical wall 50. The threads 60 permit the helical outer threads of the rigging hose 30 to threadably couple to the housing 32. Thus, threads 60 may have any size, pitch, and/or fit required to easily couple to the rigging hose 30.

Together, the inner cylindrical wall 58 and the outer cylindrical wall 50 collect water traveling down the helical outer threads of the rigging hose 30 and divert it out of the rigging hose housing 32 before it can enter an interior region (e.g., compartment 24) of the marine vessel. Water collected between the inner cylindrical wall 58 and the outer cylindrical wall 50 exits the rigging hose housing through drain hole 56. The diameter of drain hole 56 may be selected to ensure that it is large enough that all water collected between the inner cylindrical wall 58 and the outer cylindrical wall 50 is permitted to easily drain from the housing 32, and small enough that the drain hole 56 itself does not become a path for water to easily enter the housing 32. For example, in an exemplary implementation, the diameter of the drain hole 56 ranges from 3 mm to 8 mm.

Figure 6:
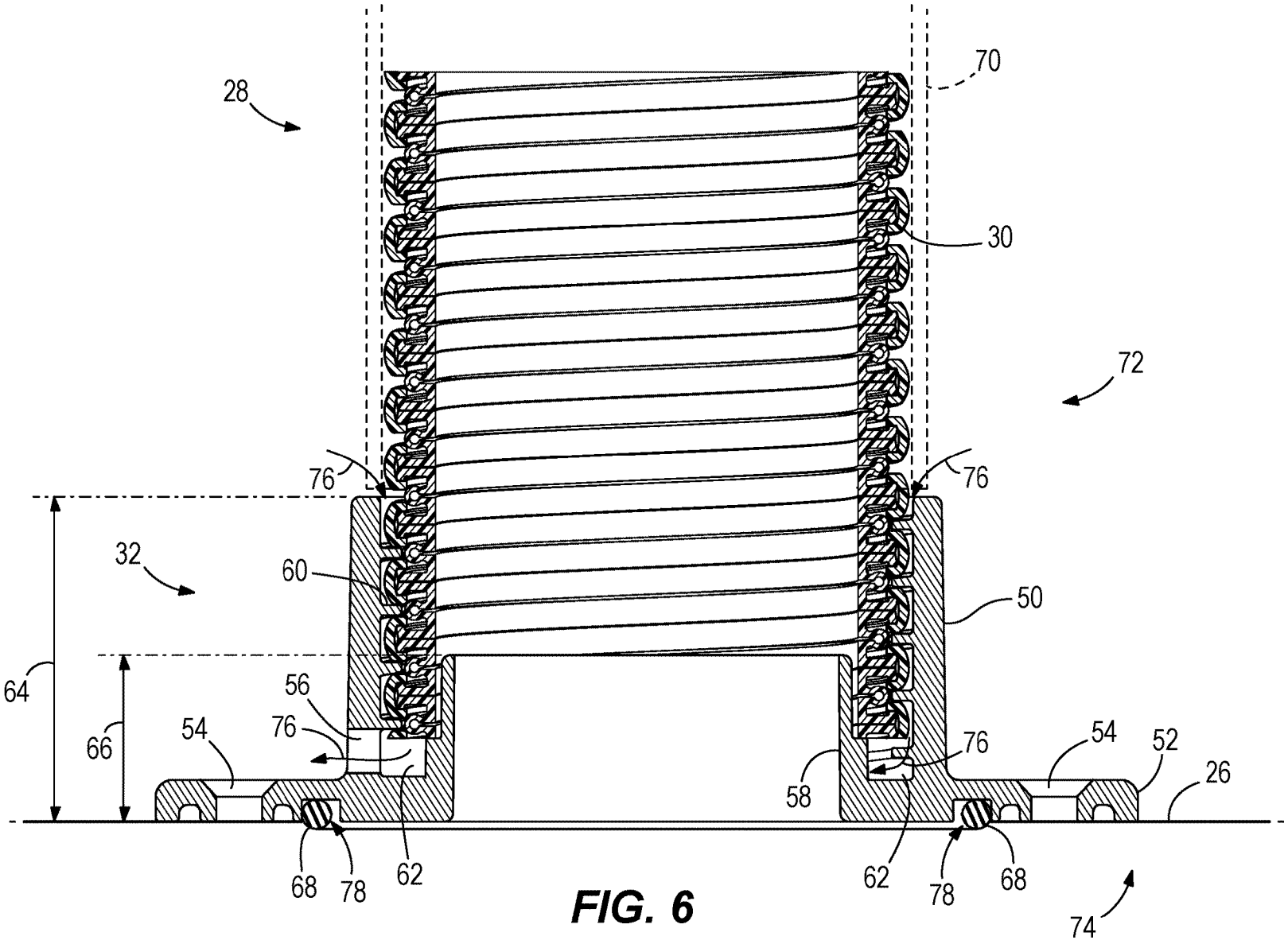
FIG. 6 is a sectional view of the rigging hose and rigging hose housing taken on line 6-6 of FIG. 3.

In an exemplary implementation, the rigging hose housing 32 includes a single drain hole 56, and the housing 32 may be mounted to a structural component (e.g., false transom 22, upper wall 26) of the marine vessel 14 such that the drain hole 56 is positioned to most efficiently remove water from the housing 32. For example, if the housing 32 is mounted on the upper wall 26 in a horizontal orientation (as depicted in FIGS. 1A and 6), the drain hole 56 may be oriented facing the stern of the vessel, that is, facing the outboard motor 10 opposite the direction of travel, so that the motion of the vessel 14 aids in expelling the water from the housing 32 through the drain hole 56. Likewise, if the housing 32 is mounted on the false transom 22 in a vertical orientation (as depicted in FIG. 1B), the drain hole 56 may be oriented facing the deck of the vessel 14, that is, toward the upper wall 26, so that gravity aids in expelling the water from the housing 32 through the drain hole 56. In other implementations, the rigging hose housing 32 may include two or more drain holes 56. In still further implementations, one or more of the drain holes 56 may be slot-shaped.

In addition to helping to divert unwanted water intrusion, the inner cylindrical wall 58 provides structural support to the rigging hose 30. When a pulling force is exerted on the hose 30, the terminating end of the hose 30 that is threadably coupled to the housing 32 has a tendency to collapse. This tendency is minimized by the presence of the inner cylindrical wall 58, which acts to support the hose 30 against collapse and increase the pull-out force required to separate the hose 30 from the housing 32, thereby preventing damage to the hose 30.

In an exemplary implementation, the rigging hose housing 32 is coupled to a structural component (e.g., false transom 22, upper wall 26) of the marine vessel 14 using mounting holes 54. The mounting holes 54 may be arranged in a radial pattern on the radial mounting plate 52. For example, as specifically depicted in FIG. 4, the rigging hose housing 32 includes four mounting holes 54 that are equally spaced, that is, spaced 90° apart, on the radial mounting plate 52. In other implementations, the housing 32 includes any number of mounting holes 54 required to securely couple the housing 32 to the structural component of the marine vessel 14. In an exemplary implementation, the mounting holes 54 are countersunk holes configured to receive flat head screws. In other implementations, the mounting holes 54 are counterbore holes or through holes, and a different type of fastener (e.g., a socket head screw, a rounded head screw, a hex head screw) is utilized to couple the rigging hose housing 32 to the structural component of the marine vessel 14.

The rigging hose 30 and the rigging hose housing 32 may be fabricated from materials that are suited to withstand the rigors of a marine environment. For example, in an exemplary implementation, both the rigging hose 30 and the rigging hose housing 32 are fabricated from polyethylene copolymer. In other implementations, one or both of the rigging hose 30 and the rigging hose housing 32 may be fabricated from another plastic or metal (e.g., aluminum) material.

Referring now to FIG. 6, a sectional view of the rigging hose assembly 28 is depicted, according to an exemplary implementation. Although FIG. 6, like FIG. 1A, depicts the rigging hose housing 32 mounted to the upper wall 26 of the marine vessel 14 in a horizontal orientation, in another exemplary implementation, the rigging hose housing 32 may be mounted in a vertical orientation on the false transom 22 of the marine vessel 14, as depicted in FIG. 1B. In further implementations, the rigging hose housing 32 may be mounted in an inclined orientation (not shown), for example, on an angular hull surface.

The outer cylindrical wall 50 is shown to extend a first height 64 above a bottom surface of the radial mounting plate 52. First height 64 may be chosen to ensure sufficient engagement between the rigging hose 30 and the threads 60 of the outer cylindrical wall 50 so that the pull-out force required to separate the hose 30 from the housing 32 exceeds a specified threshold force. The inner cylindrical wall 58 is shown to extend a second height 66 above the bottom surface of the radial mounting plate 52. The first height 64 of the outer cylindrical wall 50 is shown to be greater than the second height 66 of the inner cylindrical wall 58. In an exemplary implementation, both the outer cylindrical wall 50 and the inner cylindrical wall 58 are shown to extend substantially perpendicularly from the radial mounting plate 52, although in other implementations, one or both of the outer cylindrical wall 50 and the inner cylindrical wall 58 may be positioned at a draft angle relative to the radial mounting plate 52 to ease the difficulty of fabricating the housing 32.

As described above, the outer cylindrical wall 50 and the inner cylindrical wall 58 act to collect water traveling along a water intrusion path 76 down the helical outer surface of the hose 30 and into the housing 32. The water may be collected in an annular gutter 62 that is situated between the inner cylindrical wall 58 and the outer cylindrical wall 50. The gutter 62 is shown to terminate in the drain hole 56, which permits the expulsion of water from the housing 32. Thus, water flowing along path 76 flows around the helical outer threads of the hose 30, into and around the gutter 62 before exiting the housing 32 through drain hole 56. In some implementations, either the inner cylindrical wall 58 or the outer cylindrical wall 50 includes a stop feature which causes the hose 30 to bottom out as it is threaded into the housing 32 before it can extend into the gutter 62. In this way, adequate space for the gutter 62 is maintained, and water entering the housing 32 along path 76 is permitted to freely flow around the gutter 62 before exiting the housing 32 through drain hole 56.

Still referring to FIG. 6, in contrast to the existing rigging hose housing 132 depicted in FIG. 2, rigging hose housing 32 is shown to be fully positioned on the vessel exterior 72, as opposed to spanning both the vessel exterior 72 and interior 74. By positioning the housing 32 fully on the exterior 72, the number of paths for water intrusion into interior 74 is minimized. The radial mounting plate 52 is shown to include an annular sealing groove 78 positioned radially outward of the outer cylindrical wall 50 and radially inward of the mounting holes 54. The annular sealing groove 78 is configured to receive a sealing element 68 that is positioned between wall 26 and rigging hose housing 32 and acts to inhibit water ingress between the radial mounting plate 52 and the upper wall 26. In an exemplary implementation, the sealing element 68 is an o-ring with a circular cross-section. In other implementations, the sealing element 68 may have a different cross-sectional shape, for example, a square shape, a rectangular shape, an "X" shape, or a double "X" shape. In further implementations, the sealing element 68 may be a gasket, for example, a flange gasket.

In some implementations, an optional protective tube 70 may be positioned over the rigging hose 30 and the rigging hose housing 32. The protective tube 70 may provide additional shielding against water ingress into the housing 32, as it may prevent water from collecting on the helical outer threads of the hose 30 and running into the housing 32.

In the present disclosure, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and devices. Various equivalents, alternatives and modifications are possible within the scope of the appended claims.

What is claimed is:

1. A rigging hose housing utilized to couple a rigging hose to a marine vessel, the rigging hose housing comprising:
- a radial mounting plate;
- an outer cylindrical wall extending perpendicularly from the radial mounting plate a first height above a bottom surface of the radial mounting plate;
- an inner cylindrical wall extending perpendicularly from the radial mounting plate a second height above the bottom surface of the radial mounting plate; and
- a gutter formed between the inner cylindrical wall and the outer cylindrical wall, the gutter terminating in a drain hole formed in the outer cylindrical wall;
- wherein the drain hole is configured to permit an expulsion of fluid collected in the gutter from the rigging hose housing.

2. The rigging hose housing of claim 1, wherein the outer cylindrical wall comprises a plurality of threads configured to threadably engage with the rigging hose.

3. The rigging hose housing of claim 1, wherein the first height is greater than the second height.

4. The rigging hose housing of claim 1, wherein the radial mounting plate further comprises a plurality of mounting holes arranged in a radial pattern.

5. The rigging hose housing of claim 1, wherein the radial mounting plate further comprises a sealing element groove.

6. A rigging hose assembly for a marine vessel, the rigging hose assembly comprising:
- a structural component of the marine vessel;
- a rigging hose configured to encapsulate at least one of a hose, wire, or cable extending between an outboard motor and the marine vessel, the rigging hose comprising a plurality of external threads; and
- a rigging hose housing mounted to the structural component and threadably coupled to the external threads of the rigging hose, the rigging hose housing comprising:
  - a radial mounting plate;
  - an outer cylindrical wall extending perpendicularly from the radial mounting plate;
  - an inner cylindrical wall extending perpendicularly from the radial mounting plate; and
  - a gutter formed between the inner cylindrical wall and the outer cylindrical wall, the gutter terminating in a drain hole formed in the outer cylindrical wall;
- wherein the drain hole is configured to permit an expulsion of fluid collected in the gutter from the rigging hose housing.

7. The rigging hose assembly of claim 6, wherein the outer cylindrical wall extends a first height above the radial mounting plate, and wherein the inner cylindrical wall extends a second height above the radial mounting plate, the first height being greater than the second height.

8. The rigging hose assembly of claim 7, wherein the outer cylindrical wall further comprises a plurality of threads configured to threadably engage with the rigging hose such that a pull-out force required to separate the rigging hose from the rigging hose housing exceeds a specified threshold force.

9. The rigging hose assembly of claim 6, wherein the structural component has a horizontal orientation.

10. The rigging hose assembly of claim 6, wherein the structural component has a vertical orientation.

11. The rigging hose assembly of claim 10, wherein the structural component is a false transom.

12. The rigging hose assembly of claim 6, wherein the structural component has an inclined orientation.

13. The rigging hose assembly of claim 6, wherein the radial mounting plate further comprises a sealing element groove.

14. The rigging hose assembly of claim 13, further comprising a sealing element located in the sealing element groove between the radial mounting plate and the structural component.

15. The rigging hose assembly of claim 14, wherein the sealing element is an o-ring.

16. A rigging hose assembly for a marine vessel, the rigging hose assembly comprising:
- a rigging hose configured to encapsulate at least one of a hose, wire, or cable extending between an outboard motor and the marine vessel, the rigging hose comprising a plurality of external threads; and
- a rigging hose housing mounted to the marine vessel and threadably coupled to the external threads of the rigging hose, the rigging hose housing comprising:
  - a radial mounting plate;
  - an outer cylindrical wall extending perpendicularly from the radial mounting plate;
  - an inner cylindrical wall extending perpendicularly from the radial mounting plate; and
  - a gutter formed between the inner cylindrical wall and the outer cylindrical wall, the gutter terminating in a drain hole formed in the outer cylindrical wall;
- wherein the rigging hose housing is oriented relative to the marine vessel to aid an expulsion of fluid collected in the gutter through the drain hole.

17. The rigging hose assembly of claim 16, wherein the rigging hose housing is oriented relative to the marine vessel such that the drain hole faces a deck of the marine vessel.

18. The rigging hose assembly of claim 16, wherein the rigging hose housing is oriented relative to the marine vessel such that the drain hole faces the outboard motor.

19. The rigging hose assembly of claim 16, wherein the radial mounting plate further comprises a sealing element groove.

20. The rigging hose assembly of claim 19, further comprising a sealing element located in the sealing element groove between the radial mounting plate and the vertically-oriented structural component of the marine vessel.

* * * * *